United States Patent [19]

Arima

[11] Patent Number: 4,492,176

[45] Date of Patent: Jan. 8, 1985

[54] BOAT HULL

[75] Inventor: Juichi Arima, King County, Wash.

[73] Assignee: Arima Marine International, Inc., Seattle, Wash.

[21] Appl. No.: 336,570

[22] Filed: Jan. 4, 1982

[51] Int. Cl.[3] ..... B63B 1/00

[52] U.S. Cl. ..... 114/56; 114/271

[58] Field of Search ..... 114/56, 57, 271, 288, 114/290, 291, 356, 357, 358; D12/313, 314

[56] References Cited

U.S. PATENT DOCUMENTS

| | | | |
|---|---|---|---|
| 1,644,725 | 10/1927 | Hickman | 114/288 |
| 1,760,696 | 5/1930 | Herrmann | 114/291 |
| 1,811,981 | 6/1931 | Snadecki | 114/290 |
| 3,111,691 | 11/1963 | Luger et al. | 114/357 |
| 3,303,809 | 2/1967 | Ross | 114/56 |
| 3,342,154 | 9/1967 | Le Marec | 114/290 |
| 3,363,598 | 1/1968 | Mortrude | 114/290 |
| 3,552,349 | 1/1971 | Snow | 114/288 |
| 3,902,445 | 9/1975 | Stolk | 114/291 |
| 4,022,143 | 5/1977 | Krenzler | 114/56 |

*Primary Examiner*—Sherman D. Basinger
*Assistant Examiner*—Jesùs D. Sotelo
*Attorney, Agent, or Firm*—Seed and Berry

[57] ABSTRACT

A motorized pleasure boat having an essentially V-shaped hull. Pairs of strakes are placed on each side of the hull bottom to reduce side slipping and to increase planing efficiency. Stern extensions project rearwardly from the transom to further improve planing efficiency. The stern extensions have inner surfaces which additionally reduce side slipping. The length-to-width ratio of the hull is substantially less than that of traditional hulls.

23 Claims, 7 Drawing Figures

BOAT HULL

DESCRIPTION

Technical Field

This invention is directed to boats, and more particularly, to a hull configuration for motorboats which is fuel efficient and provides adequate turning stability.

Background Art

Motorized pleasure boats have a typical length-to-width ratio in the range of 2.41:1 to 2.73:1. When these boats are operated, a large amount of power is required to accelerate them from lower speeds to higher speeds where they can operate in a more efficient planing mode. When such boats are used to tow skiers, as is commonly done, the power requirements are even greater.

Modern motorized pleasure boats are often provided with hulls having V-shaped transverse cross-sections which vary in steepness from bow to stern. Strakes are often provided along each side of the V-shaped cross-section. These strakes form step-like protrusions which interrupt the smooth contour of the V-shaped hulls. The horizontal surfaces of these strakes assist in getting the boat up on plane, while the vertical surfaces of the step serve to reduce side slipping of the boat when it is negotiating turns.

While the vertical surfaces of these strakes provide resistance to prevent the boat from sliding out of control as it negotiates a turn, they also create turbulence in the area around the strakes. This turbulence leaves a trail of aerated water behind it. Because the boat is traveling both forward and sideways as it negotiates a turn, the path or movement of this aerated water tends to be directly back toward the propeller, causing cavitation and reduced propulsion efficiency. It can be seen, then, that there is a need for a boat hull design which can maximize the resistance of the boat to side slipping during a turn and yet avoid the propeller cavitation difficulties associated with existing designs.

Motorized pleasure boats traditionally have a straight transom extending across the entire width of the boat. A disadvantage of the straight transom is that it provides little or no uplifting or planing surface aft of the center of gravity of the motor. Surfaces aft of the motor will necessarily be a greater distance from the center of flotation of the hull than the weight of the motor and, consequently, will provide the most effective uplifting forces to oppose the weight of the motor.

Leveling planes or trim tabs are frequently added to the end of the transom to provide uplifting forces aft of the motor and to assist in getting the boat into a planing position as easily as possible during operation. These trim tabs are thin plates which project rearwardly from the transom, providing additional uplifting surface area. Because of their relatively thin size, generally around $\frac{1}{8}$ inch, trim tabs are incapable of providing any substantial amount of resistance to side slipping.

It is desirable, therefore, to find a hull design which can provide planing efficiency beyond that of the straight transom designs without the necessity of adding leveling planes to the end of the transom. Additionally, it is desirable to find a hull design which will provide a planing surface aft of the motor while simultaneously providing additional protection from side slipping.

DISCLOSURE OF THE INVENTION

It is an object of this invention to provide an improved fuel-efficient hull for a motorized, recreational pleasure boat.

It is another object of this invention to provide a hull for such boats which will provide adequate resistance to side slipping during turns without creating cavitation problems which result in loss of propeller efficiency.

It is another object of this invention to provide a lightweight, easily transportable, highly fuel-efficient, recreational pleasure boat having a large carrying capacity.

It is another object of this invention to provide an improved hull for motorized pleasure boats wherein the rear transom portion of the hull is designed to provide improved planing efficiency, as well as additional resistance to side slipping.

It is another object of this invention to provide a hull for such boats having strakes which produce a minimum amount of turbulence.

These and other objects of the invention are obtained by providing a hull which is wider than traditional hulls, giving it a length-to-width ratio much smaller than the normal range for pleasure boats. The bottom portion of the hull is comprised of substantially V-shaped cross-sections which become increasingly steep when moving from the stern of the boat toward the bow. Along most of the length of the hull, each side of the hull has a pair of closely placed strakes to resist side slipping and increase planing efficiency. A horizontal wing portion is provided at the chines on either side of the hull. The hull is provided with stern extensions on the outer sides of the stern to increase the area available for planing during initial acceleration and normal cruising speeds and to provide a vertical surface for additional resistance to side slipping.

BEST MODE FOR CARRYING OUT THE INVENTION

Figure 4:
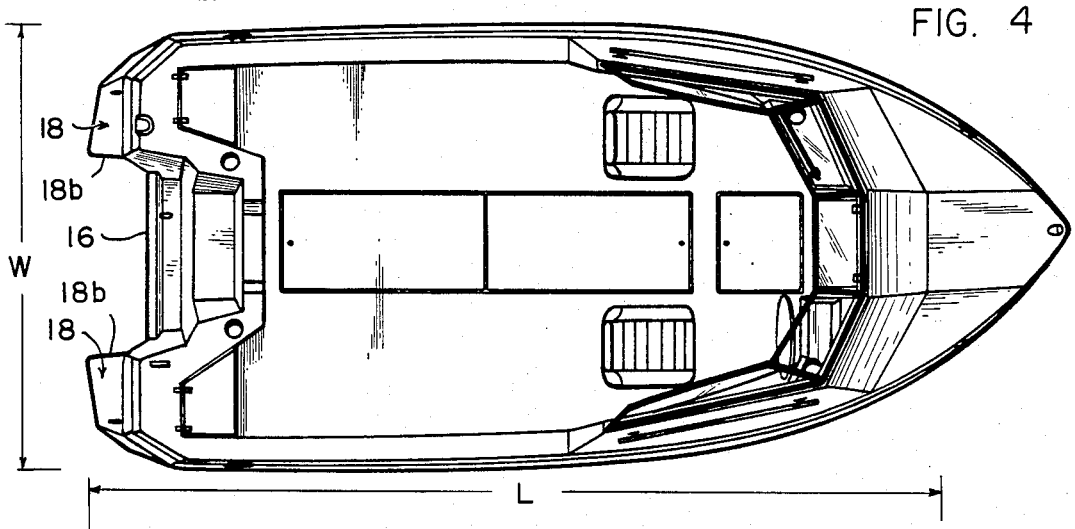
FIG. 4 is a top plan view of such a boat.

As perhaps best seen in FIG. 4, the preferred embodiment of this invention has a length L and a width W, with a length-to-width ratio of approximately 2:1 (i.e., for a typical length of 14 feet 4 inches, the beam will be 7 feet 0 inches). The 14-foot version of the preferred embodiment illustrated here has an estimated displacement (allowing for a factor of safety) of approximately 620 lbs. and a maximum weight capacity of approximately 1600 lbs.

The hull of this invention has a substantially V-shaped bottom portion 10 which becomes increasingly steep when moving from the stern of the boat toward the bow. The hull is provided with elongated strakes 12*a* and 12*b*. These strakes are positioned abutting one another and provide a vertical surface or step to resist sidewise slipping, as well as horizontal surfaces to increase planing efficiency. The steps are provided in two stages so that neither step is large enough to create substantial turbulence. Cavitational difficulties resulting in propulsion problems during cornering are thereby reduced.

In the preferred embodiment, the vertical surfaces are limited to a height of about 2.54 cm. (1 in.) in order to avoid excessive turbulence. The horizontal surfaces may be as large as is desired, but are limited in the preferred embodiment to the width corresponding to a rise equal to the vertical step height for a hull inclination equal to that inboard of the strakes.

The strake surfaces are described herein as being horizontal and vertical. Although these orientations are the most efficient for the purposes used here, difficulties in molding such surfaces necessitate the use of surfaces which, in fact, deviate from the vertical or horizontal by 2°–5°. Even deviation of as much as 10° will still provide adequate, although not maximum, results.

Figure 5:
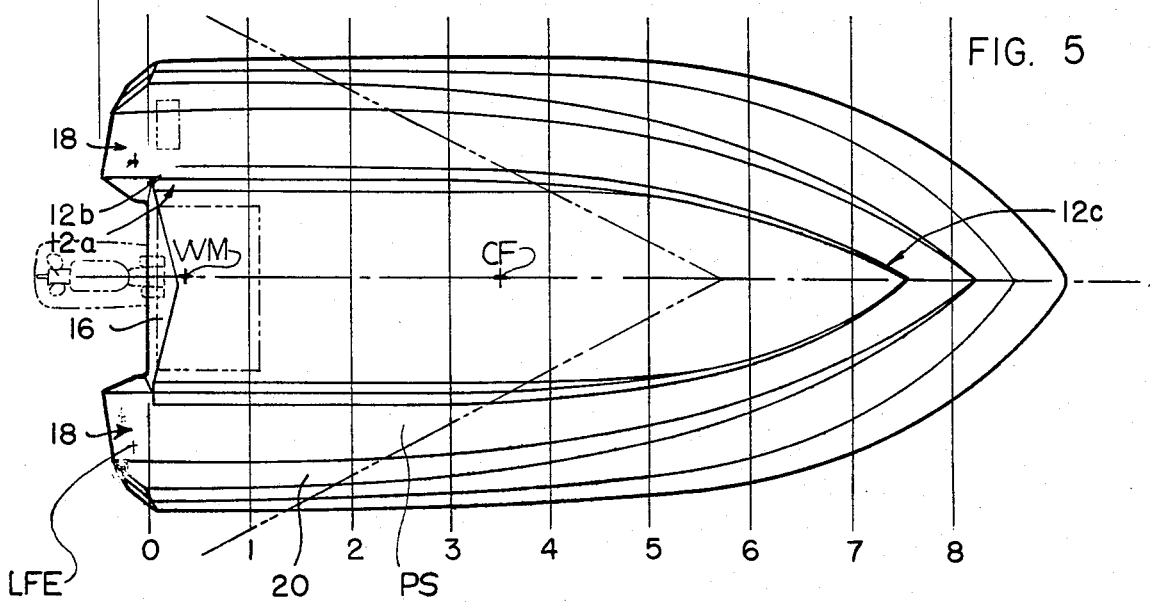
FIG. 5 is a bottom plan view of such a boat.
Figure 7:
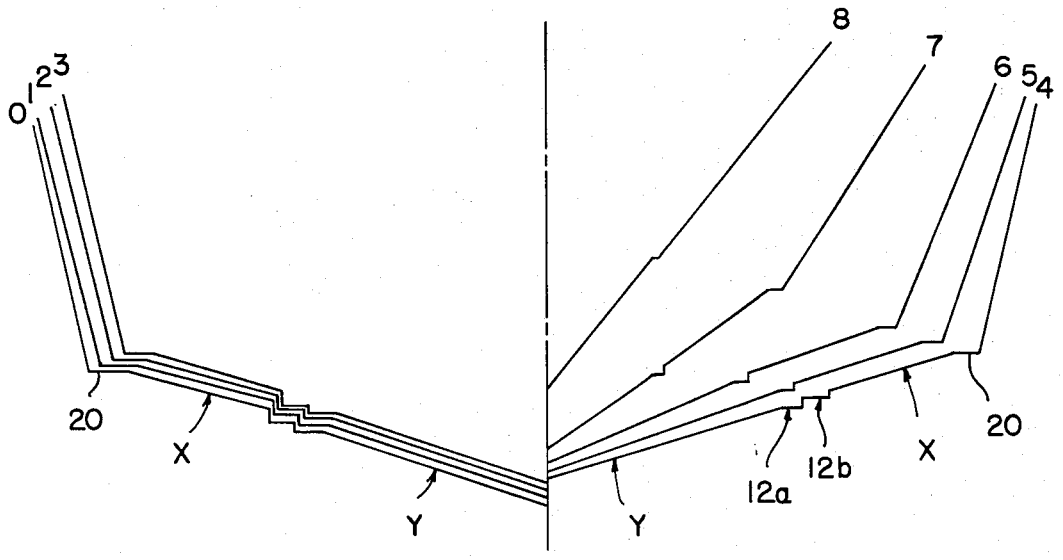
FIG. 7 is a drawing indicating the contours of the transverse cross-sections of the hull illustrated in FIG. 5 corresponding to locations along the longitudinal axis of the boat hull indicated by lines 0 through 8 in FIG. 5.

As seen in FIGS. 5 and 7, the strakes 12*a*, 12*b* merge near the bow of the boat, between positions 4 and 5 to form a single strake 12*b*, and finally dissolve into a small transition line 12*c*, thus yielding a hull line at the bow which is relatively smooth so as to reduce the pounding of the hull as it breaks through waves. The area outboard of the double strakes is identified by the letter X and is clear of all strakes. Similarly, the area inboard of the double strakes is identified by reference letter Y and is also clear of strakes.

Figure 6:
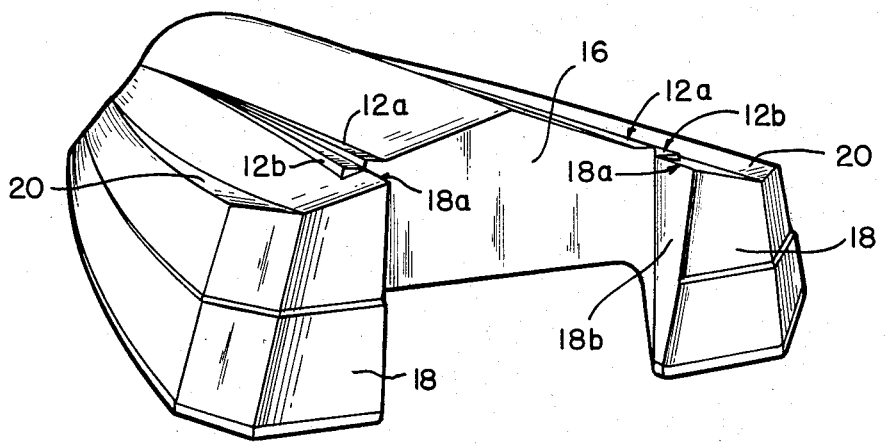
FIG. 6 is a perspective view of an inverted boat hull embodying the principles of the invention.

As best seen in FIG. 6, the stern of the boat has a straight transom section 16 positioned at the central portion of the stern. Stern extensions 18 project rearwardly beyond the straight transom section on either side of the straight transom section 16. The stern extensions 18 are formed by extending the X portion of the bottom of the hull and the wings 20 rearwardly. The lower inner corner surfaces 18*a* of the stern extensions 18 merge with the line formed by the intersection of the strakes 12*a* and 12*b*. These stern extensions 18 enable the hull to maintain a high lifting surface without increasing the overall length of the boat along the shear line. Thus, the boat, in effect, is a small length boat with a hull bottom surface approximating that of a much larger boat. This configuration gives the boat a much more efficient and much larger planing surface so that the boat will get up on plane with much smaller horsepower than a boat of comparable size without stern extensions. Similarly, the boat will remain on plane at a much lower horsepower than any comparable boat of the same size not having stern extensions.

Figure 1:
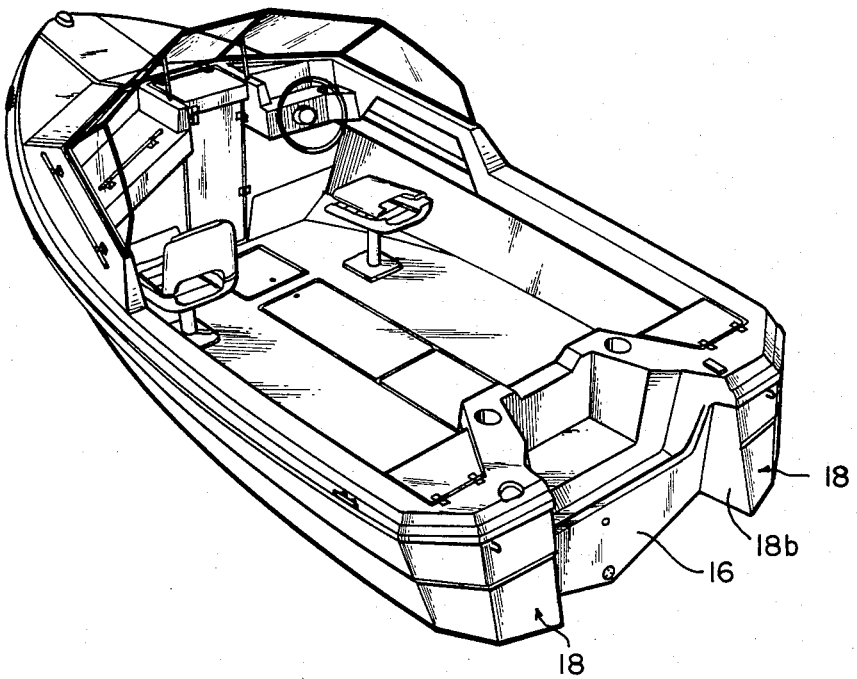
FIG. 1 is a perspective view of a boat embodying the principles of the invention.
Figure 2:
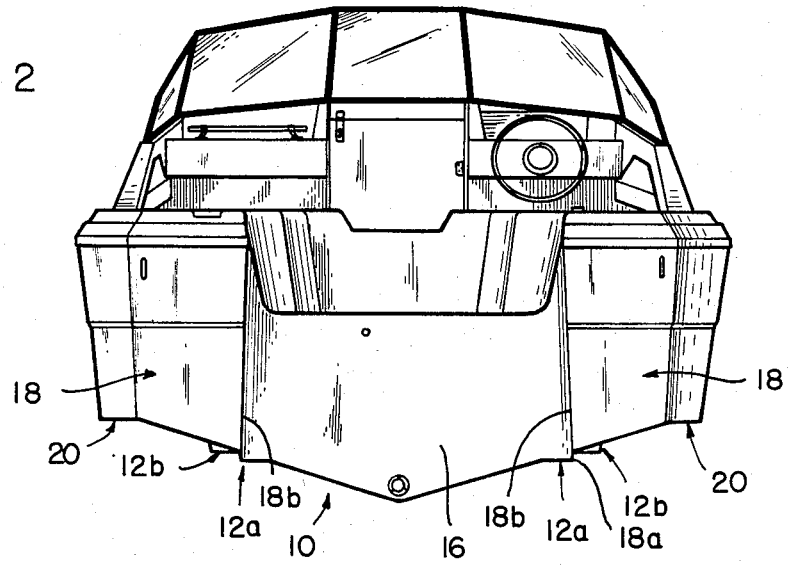
FIG. 2 is a rear elevation view of such a boat.
Figure 3:
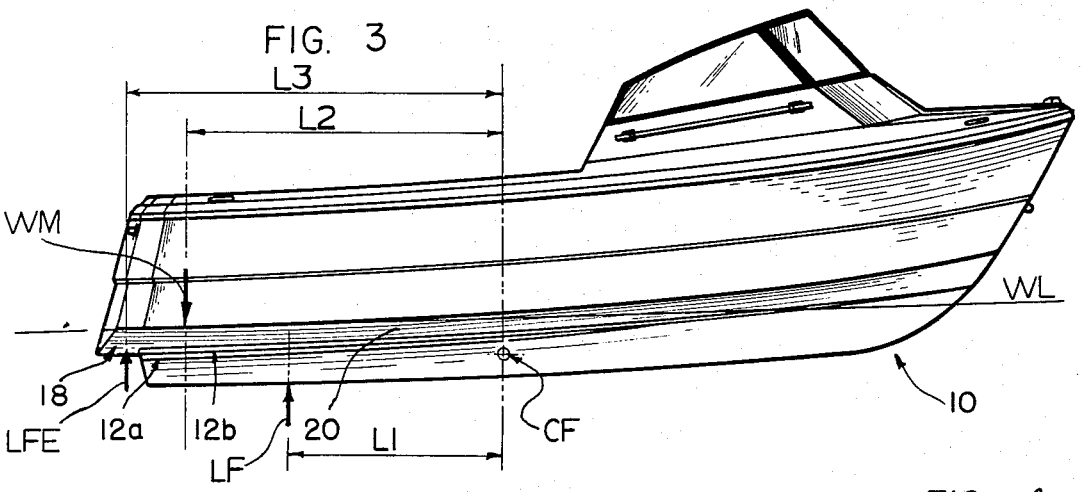
FIG. 3 is a side elevation view of such a boat.

The advantages of a hull having stern extensions such as those of the invention can be seen by reference to FIGS. 3, 4 and 5. The motor and accessories (shown in phantom in FIG. 5) are positioned at the rear of the boat and produce a resultant downward force WM positioned as shown. In a boat having no stern extensions 18, the resultant lifting force LF produced by the planing surface of the hull PS (see FIG. 5) is positioned as shown in FIG. 3.

The stern extensions 18 not only provide additional planing area but increase the stability of the boat as well. Because the resultant uplifting forces LFE caused by the planing surfaces of the stern extensions 18 are located aft of the motor and, consequently, further from the center of flotation CF than the resultant motor weight WM, they are of increased effectiveness in keeping the boat balanced about the center of flotation.

The submerged portions of the vertical surfaces of the stern extensions 18 also provide protection against side slipping. When the boat is turning to the port side, for example, the inner sidewall 18*b* of the left stern extension will oppose side slipping.

While the principles of the invention have been illustrated and described here, it should be understood that variations will be apparent to one skilled in the art without departing from the principles herein described. Accordingly, the invention is not limited to the specific embodiment illustrated in the drawings.

I claim:

1. A motorized recreational boat with a single hull wherein the bottom of the hull of the boat comprises:

a lower hull portion having a series of V-shaped transverse cross-sections, the cross-sections having increasingly steep angles from the stern to the bow of the boat, the lower hull portion terminating outwardly in an upper edge;

a pair of abutting strakes positioned at the upper edge of the lower hull portion of each of the port and starboard sides of the hull, each of said pairs of strakes having a first strake projecting outwardly, then upwardly from the upper edge of the lower hull portion, the second strake projecting outwardly, then upwardly from the uppermost portion of the first strake, each of said pairs of strakes forming a pair of substantially horizontal surfaces for planing and a pair of substantially vertical surfaces for resisting side slippage, each of said pairs of strakes extending from a position toward the stern of the boat to a position forward of the midportion of the hull, each of said pairs of strakes forming into a single strake extending from the midportion of the hull to a position toward the bow of the boat;

a middle hull portion extending upwardly and outwardly from the uppermost portion of each of said second strakes to the chine of the boat; and an upper hull portion extending upwardly from the chine of the boat to form the hull sides.

2. The boat of claim 1 wherein each strake of each of said pairs of strakes and said single strake diminishes in size as it extends toward the bow of the boat.

3. The boat of claim 1 wherein the lower strake of each of said pairs of strakes terminates between $\frac{1}{2}$ and $\frac{5}{8}$ of the distance along the planing waterline from the stern of the boat to the bow of the boat, and the upper strake of each of said pairs of strakes continues therebeyond to form said single strake with only said single strake extending over the hull along the forward at least $\frac{3}{8}$ of the distance along the waterline.

4. The boat of claim 3 wherein each of said single strakes converges into a single line near the bow of the boat.

5. The boat of claim 1 wherein said vertical surfaces for resisting side slipping formed by each of said pairs of strakes are sized to minimize turbulence.

6. The boat of claim 5 wherein the surfaces for resisting side slipping are about 2.54 cm. (1 in.) or less in vertical projection.

7. The boat of claim 1, wherein said middle hull portion includes a wing projecting outwardly along an upper portion of said middle hull portion and terminating at the chine of the boat, said wing forming a substantially horizontal surface for planing at low speeds and for resisting side slippage during high speed turns of the boat.

8. The boat of claim 1, further including a pair of transversely spaced stern extensions projecting rearwardly from said middle hull portion, each of said stern extensions extending outwardly and forming a substantially flat first surface for additional planing rearward of a transom of the boat, and each of said stern extensions extending upwardly and forming a substantially flat and vertically oriented second surface for additional resistance against side slippage, each of said second extension surfaces facing toward the longitudinal center line of the boat and the other second extension surface, and extending upward from said first extension surface of said stern extension.

9. The boat of claim 8 wherein each of said stern extensions has a lower innermost corner defined by the junction of said second extension surface and said first extension surface, each of said corners being substantially contiguous with a line formed by the intersection of said substantially vertical surface of said first strake and said substantially horizontal surface of said second strake.

10. The boat of claim 8 wherein the height of said second extension surfaces for resisting side slippage is less than the width of said first extension surfaces for planing.

11. The boat of claim 8 wherein each of said second extension surfaces extend sufficiently below the waterline existing before achieving planing to hold the boat on a substantially straight course at low speed.

12. The boat of claim 8 wherein said stern extensions provide sufficient lift before achieving planing speed to maintain the boat at an attitude substantially equivalent to the planing speed attitude.

13. The boat of claim 8 wherein said first surface of each of said stern extensions has an outwardly facing, rearward corner portion with an oblique edge relative to the longitudinal center line of the boat for presenting a flat corner edge to the water during high speed turns.

14. The boat of claim 1 wherein each of said pairs of strakes are positioned for submergence with respect to the planing waterline over a substantial portion of their length.

15. The boat of claim 1 wherein the height of each of said first and second strakes is less than the width of each of said strakes.

16. The boat of claim 1 wherein the length of the boat is approximately ½ the width of the boat.

17. A motorized recreational boat with a single hull wherein the bottom of the hull of the boat comprises:

a lower hull portion having a series of V-shaped transverse cross-sections, the cross-sections having increasingly steep angles from the stern to the bow of the boat, the lower hull portion terminating outwardly in an upper edge;

a pair of adjacent strakes positioned at the upper edge of the lower hull portion of each of the port and starboard sides of the hull, each of said strakes of said pairs of strakes projecting outwardly, then upwardly to provide a substantially horizontal surface for planing and a substantially vertical surface for resisting side slippage, each of said pairs of strakes extending continuously from a position toward the aft of the boat below the planing water line to a position toward the bow of the boat above the planing waterline, said pair of strakes merging into a single strake above said water-line and extending toward the bow to present a relatively smooth bow hull profile, said pair of strakes and single strake having decreasing cross-sections as they extend toward the bow of the boat;

a middle hull portion extending upwardly and outwardly from the uppermost positioned strake of each of said pairs of strakes to the chine of the boat, said middle hull portion having a pair of transversely spaced stern extensions projecting rearwardly, each of said stern extensions extending outwardly and forming a substantially flat first surface for additional planing rearward of a transom of the boat, and extending upwardly and forming a substantially flat and vertically oriented second surface for additional resistance against side slippage, each of said second surfaces facing toward the other of said second surfaces; and an upper hull portion extending outwardly from the chine of the boat to form the hull sides.

18. A motorized recreational boat with a single hull wherein the bottom of the hull of the boat comprises:

a lower hull portion extending outwardly and upwardly along at least a part of said lower hull portion length from the longitudinal center of the hull toward the port and starboard sides of the hull;

a pair of abutting strakes positioned at the upper edge of the lower hull portion of each of the port and starboard sides of the hull, each of said pairs of strakes having a first strake projecting outwardly, then upwardly from the upper edge of the lower hull portion, the second strake projecting outwardly, then upwardly from the uppermost portion of the first strake, each of said pairs of strakes forming a pair of substantially horizontal surfaces for planing and a pair of substantially vertical surfaces for resisting side slippage, each of said pairs of strakes extending from a position toward the stern of the boat to a position forward of the midportion of the hull, each of said pairs of strakes forming into a single strake extending from the midportion of the hull to a position toward the bow of the boat;

a middle hull portion extending outwardly and upwardly along at least a part of said middle hull portion length from the uppermost portion of each of said second strakes to the chine of the boat; and an upper hull portion extending upwardly from the chine of the boat to form the hull sides.

19. The boat of claim 18, further including a pair of transversely spaced stern extensions projecting rearwardly from said middle hull portion of each of the port and starboard sides of the hull, each of said stern extensions extending outwardly and forming a first surface for additional planing rearward of a transom of the boat, and each of said stern extensions extending upwardly and forming a generally vertically oriented second surface for additional resistance against side slippage, each of said second extension surfaces facing toward the longitudinal center line of the boat and the other second extension surface, and extending upwardly from said first extension surface of said stern extension.

20. The boat of claim 19, wherein said middle hull portion includes a wing projecting outwardly along an upper portion of said middle hull portion and terminating at the chine of the boat, said wing forming a substantially horizontal surface for planing at low speeds and for resisting side slippage during high speed turns of the boat, said wing projecting rearwardly to form an outward extension of said first surface of said stern extension.

21. The boat of claim 19 wherein each of said first extension surfaces extend sufficiently below the waterline to provide sufficient lift to maintain the boat at an attitude substantially equivalent to the planing speed attitude at all speeds.

22. The boat of claim 19 wherein said first surface of each of said stern extensions has an outwardly facing, rearward corner portion with an oblique edge relative to the longitudinal center line of the boat for presenting a flat corner edge to the water during high speed turns.

23. The boat of claim 19 wherein said first surface of each of said stern extensions terminates in an edge substantially transverse to the longitudinal center line of the boat.

* * * * *